United States Patent [19]

Gamvrellis

[11] 4,020,789

[45] May 3, 1977

[54] FABRIC MARKER

[76] Inventor: Steve Gamvrellis, 3860 35th St., San Diego, Calif. 92104

[22] Filed: Feb. 26, 1975

[21] Appl. No.: 553,232

Related U.S. Application Data

[63] Continuation-in-part of Ser. No. 421,918, Dec. 5, 1973, abandoned.

[52] U.S. Cl. ..... 118/308; 118/41; 118/50; 118/315

[51] Int. Cl.[2] ..... B05C 19/00

[58] Field of Search ..... 118/308, 50, 310, 410, 118/311, 411, 312, 40, 315, 41, 640; 33/2 H, 2 R, 9 A; 222/425

[56] References Cited

UNITED STATES PATENTS

| | | | |
|---|---|---|---|
| 2,473,451 | 6/1949 | Sciancalepore | 118/41 |
| 2,571,976 | 10/1951 | Ward | 118/308 X |
| 2,694,257 | 11/1954 | Centannz | 33/2 H |
| 2,921,555 | 1/1960 | Schwartz | 118/308 |
| 3,210,849 | 10/1965 | Ohlin | 33/9 A |
| 3,556,832 | 1/1971 | Park | 118/410 X |
| 3,742,899 | 7/1973 | Alperin et al. | 118/2 |
| 3,785,898 | 1/1974 | Gerber et al. | 118/50 X |

*Primary Examiner*—John P. McIntosh
*Attorney, Agent, or Firm*—Bruno J. Verbeck; John L. Haller

[57] ABSTRACT

A fabric marking device for producing a powder mark of predetermined shape and size on pieces of fabric. The device comprises a table with a perforated work surface area and means for delivering powder under air pressure to one or more tubes having a lengthwise slit therein which is placed against a surface of fabric to be marked. Means are provided for altering the angle of the tubes relative to each other, and/or to the fabric to be marked, and for varying the distance between the tubes and work surface to accommodate marking a stack of fabric layers simultaneously.

5 Claims, 4 Drawing Figures

AIR FLOW
TO VACUUM COLLECTOR

FABRIC MARKER

This is a continuation-in-part of my pending application, Ser. No. 421,918, filed 12-05-73, now abandoned.

FIELD OF THE INVENTION:

The invention relates to an improved fabric marking device, and more particularly to a unique fabric marking device for producing powder markings of a predetermined size, shape and angle on one or more layers of fabric.

PRIOR ART:

In the garment industry the marking of clothing during manufacture is a common and necessary operation. I am aware that attempts have been made in the past to expedite and simplify such marking operation, and I am also aware of the disclosures of such prior art as U.S. Pat. No. 2,694,257 and U.S. Pat. No. 3,742,899.

The foregoing prior art devices, however, do not permit of the practical and efficient marking of multiple layers of fabric simultaneously and accordingly are of little benefit where fast, accurate marking of fabric is essential as it is in the highly competitive garment industry.

SUMMARY OF THE INVENTION:

A principal object of the present invention is to provide an improved fabric marking device which will enable an operator to mark a fabric, or to simultaneously mark a multiplicity of layers of fabric with predetermined designs quickly, accurately and efficiently.

My device can be used in garment factories and in tailor and alteration shops to mark cuffs, pockets, designs for embroidery and braiding, and various other markings as desired.

The foregoing and other objects of my invention, together with the advantages thereof, will be disclosed hereinafter, or will be apparent, from the detailed description which follows, in light of the accompanying drawings, wherein.

The marking device of my invention makes use of compressed air mixed with marking powder to effect forced penetration through one or more layers or plies of fabric simultaneously and to deposit on and in the fabric layers predetermined designs, including straight lines. Pressurized air from a suitable source is controllably released into a conduit connected to a container of marking powder. Passing into, and out of the container through another conduit, the air picks up a predetermined quantity of marking powder, and the mixture of air and powder is conveyed to the top layer of fabric, and then into and through the layer or layers leaving a distinct and accurate indicia on both sides of each ply of fabric.

Figures 1, 2, 3:
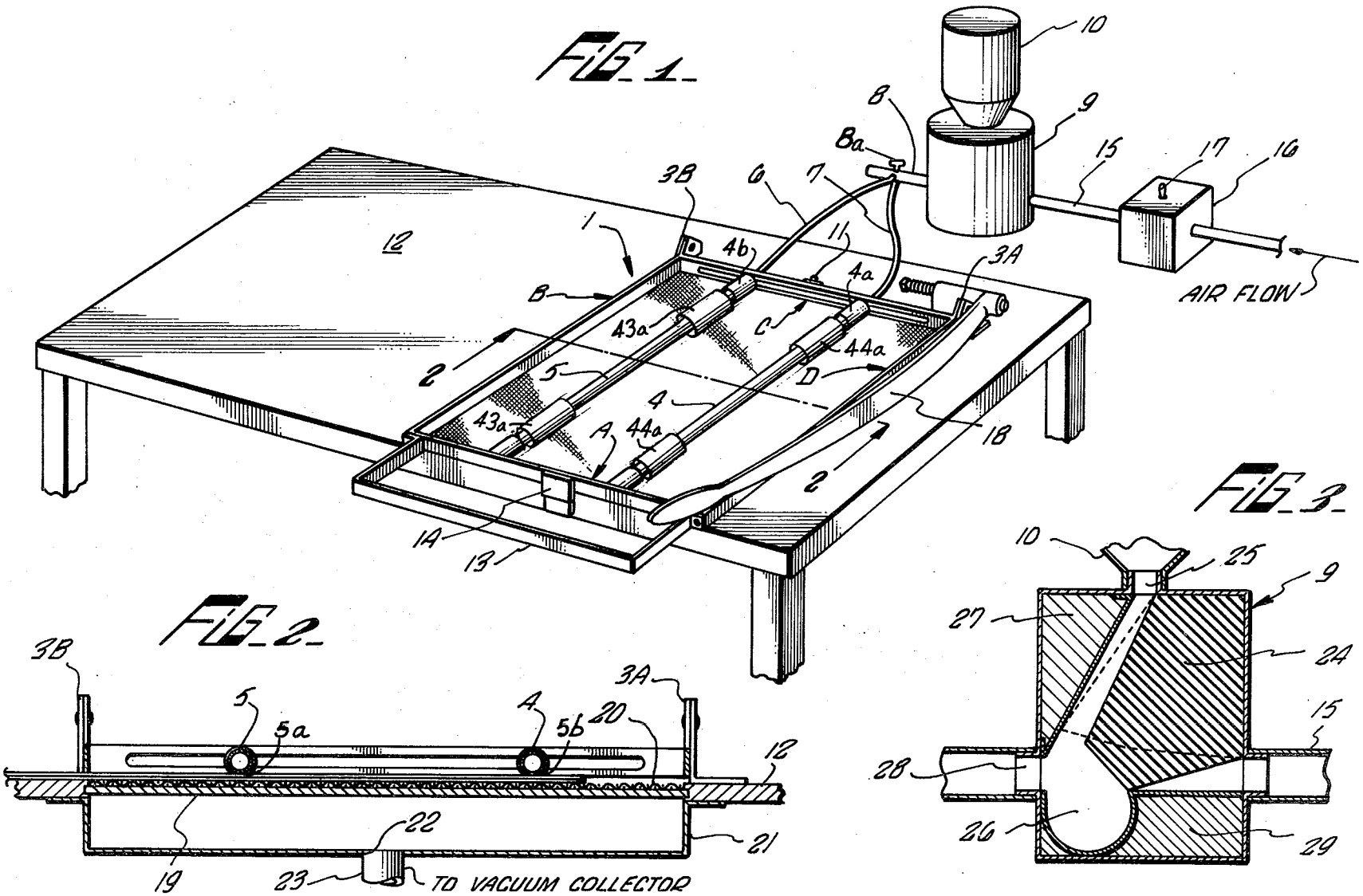
FIG. 1 is a view in perspective of one form of marking device according to my invention, assembled and installed for use.
FIG. 2 is a sectional view taken on line 2—2 of FIG. 1.
FIG. 3 is a sectional view of a dispensing and mixing valve.

Referring to FIG. 1, there is shown a rectangular frame 1 installed on a table 12. The frame 1 is springhinged at 3*a* and 3*b* as shown. Marking tubes 4 and 5 are adjustably positioned on the frame 1 as by threaded connectors 4*a* and 4*b*, or in any other suitable way, so they can be moved away from or toward each other, i.e. to the left or right as desired. The tubes 4 and 5 each have a slit 5*a* and 5*b* running lenghtwise. These slits may be adjusted in length as by means of sleeves 43*a* and 44*a* around the tubes 4 and 5. The width of the slits 5*a* and 5*b* is approximately 1/32 of an inch. The tubes 4 and 5 are, each of them, connected with a conduit 6 and 7, these being in turn connected with that section of conduit 8 that is after (left of) dispensing and mixing valve 9. A valve 8*a* is adapted to close or open the entrance to either conduit 6 or 7 if and when it is so desired.

Dispensing and mixing valve 9 contains a predetermined amount of marking powder which is picked up by the pressurized air and is forced through conduit 8, and when valve 8*a* is open into conduits 6 and 7 and through the slits 5*a* and 5*b* of tubes 4 and 5 onto and through fabric placed on the work surface of frame 1 on table 12. A light source 11 provides a guide beam for ease of positioning of the fabric to be marked.

The frame 1 is provided with a handle 13 and latch means 14. When the handle 13 is pushed down the frame 1 is pressed against the surface beneath it and the latch 14 holds the frame 1 tight. When the handle 13 is pulled upwards, the latch 14 opens permitting the frame 1 to spring up and open.

Positioned on top of dispensing and mixing valve 9 is a powder container 10. The powder container 10 is threadably secured to the dispensing and mixing valve 9. Conduit 15, which is conveniently of metal, is connected to a valve 16 opened an closed by means of handle 17. The air shown as entering the valve means 16 is under pressure. An edge D of the frame 1 is sharp and preferably formed of tempered steel. A cutting knife 18 serves to cut off excess fabric as desirable.

In FIG. 2, is shwon the interior of tubes 4 and 5; also shown are steel beams 19 running parallel to tubes 4 and 5, and supporting a screen 20. Besides supporting the screen 20, the steel beams 19, when spaced closely to each other prevent the marking powder from spreading horizontally, and the powder is routed downward instead. A pan 21, attached as shown, confines the area under the screen 19 through which the powder passes. An aperture 22 in the bottom of pan 21 has a vacuum hose 23 connected to it. In use all expelled marking powder is removed to a filter, thus keeping the device and the surrounding area free of dust.

The dispensing and mixing valve 9 shown in FIG. 3 comprises a rubber diaphragm 24 which may be formed of pre-molded rubber which covers the end of the air line 15 when the air is not flowing. A threaded connecting means 25, which can be threaded on the outside, is connectable to a can of marking powder, which may have a suitable threaded portion for connecting to valve 9. The marking powder flows by gravity from the can 10 through connection 25 and into void 26 on the inside of vlave 9. When valve 16 is opened to air flow, air flows through line 15 forcing the flexible diaphragm 24 into engagement with shoulder 27 thereby stopping the flow of powder into valve 9 from container 10. Simultaneously the air will pick up powder previously deposited in void 26 for delivery through an opening 28 and thence into tubes 4 and 5.

Figure 4:
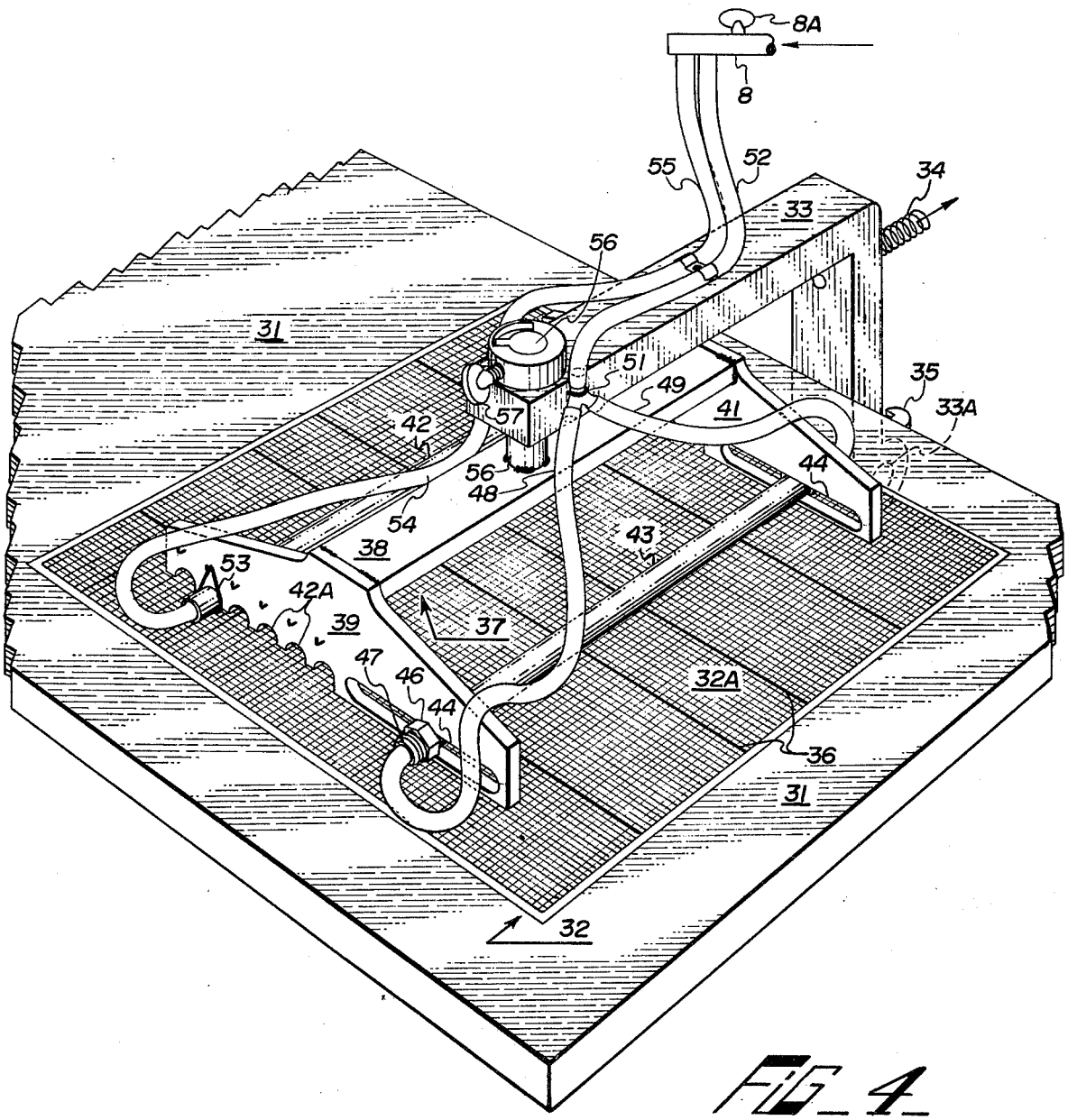
FIG. 4 is a view in perspective of another form of the marking device of my invention.

Another embodiment of my invention is illustrated in FIG. 4. A mixture of air under pressure and powder flows into conduit 8, with that conduit and elements 9, 10, 15, 16 and 17, and the arrangement and relationship thereof being as shown in FIG. 1, and described heretofore.

Still referring to FIG. 4 a rectangular frame 31 of rigid material such as metal or plastic, has a work surface area 32 which is perforate, and in this preferred embodiment is an aperture covered by a screen 32*a*. Reinforcing rods 36 secured to the edges of the screened aperture defining the work surface area 36 serve to hold the screen 32*a* in place and support it.

Connected to the frame 31 by a hinge 33*a* is a rigid arm member 33 which extends over the work surface area 32. A spring 34 urges arm 33 to an open position when the latch 35 is disengaged. A tube rack 37 of metal or the like comprises a yoke 38 and side panels 39 and 41.

Tubes 42 and 43, preferably of metal and each having a lengthwise slit in the part of the tubes 42 and 43 facing the work surface area 32. The slits are preferably about 1/32 inches wide. Tube 43 is movably positioned with its ends supported by slots 44 and 45 and can be secured fast by a nut 46. The other end of the nut 46 is secured through a threaded member 47 to a conduit 48. The other end of tube 43 is similarly secured by a nut (not shown) to conduit 49. Conduits 48 and 49 are connected by a three-way connector 51 to a conduit 52. The other end of conduit 52 is connected to conduit 8, which latter is connected to the elements shown in FIG. 1 which, as previously mentioned, are common to FIG. 1 and FIG. 4.

One end of conduit 42 is supported within a groove 42*a* in side panel 39 by a spring 53, as is the other end (not shown). The end of tube 42 supported by spring 53 can be moved to any one of the other grooves shown, and similarly supported to enable positioning of tube 42 at various angles across the work surface area 32, and consequently across the fabric which is placed on the work surface area 32 to be marked. Conduit 54 is connected by any suitable means to tube 42, and through a three way connector similar to connector 51, to conduit 55. The latter is joined to conduit 8. A valve 8*a* opens or shuts the flow of powder and air to tubes 42 and 43.

The yoke 38 is secured to a rod 56 which is slidably movable through an aperture in arm member 33 and can be secured, after such movement, by tightening of the key 57. Of course the entire yoke and attached side panels can, thus, not only be raised up and down to accommodate various thicknesses of fabric which is to be placed on the work area 32 for marking, but can also be turned to provide markings on the fabric at any desired angle. As with the embodiment shown in FIG. 1, a pan (not shown in FIG. 4) is suitably located below screen 32*a* for collecting powder which comes through the screen 32*a*. Furthermore a number of other adjustments of the members can be made as may be desirable, as those skilled in the art will appreciate, within the scope of my invention.

I claim:

1. A fabric marking device comprising:

A. a frame having a work surface including an area perforated therethrough; means for depositing a marking powder on at least one predetermined line simultaneously through multiple layers of fabric positioned on said perforated area, thereby leaving a distinct and accurate indicia on both sides of the fabric layers;

B. said means including at least one tubular member having a lengthwise slit through the wall thereof, and connected to a source of marking powder emitable through said slit under sufficient pressure for the powder to pass through said layers;

C. said tubular member, or members, being controllably positioned with the slit thereof ready for contact with a fabric layer positioned on said perforated area;

D. a marking powder container;

E. means for delivering marking powder from said container to a mixing valve whereby said mixing valve accepts a predetermined quantity of marking powder;

F. means for delivering air under pressure to said valve, said valve being provided with means whereby said delivery of pressurized air interrupts said marking powder delivery means, said predetermined quantity of marking powder is mixed with said pressurized air for deposit on said fabric layers, and said marking powder delivery means are reactivated to provide subsequent delivery of a predetermined quantity of marking powder when said air delivery means are deactivated;

G. conduit means connecting said tube, or tubes, to said valve.

2. The device of claim 1 including means for changing the length of said slit.

3. The device of claim 2 including powder-collecting means positioned below the said perforated area.

4. The device of claim 3 wherein the said depositing means comprises at least two spaced-apart tubes.

5. The device of claim 4 wherein said depositing means comprises a member hinged to said frame, said member having an open position and a closed position, said member being in its closed position when it is closest to said work surface; spring means for urging said member to its open position; a locking device for maintaining said member in its closed position; means for varying the distance between said tubes and said work surface; and means for positioning said tubes at a predetermined angle in a plane parallel to said work surface.

* * * * *